US010589920B2

(12) United States Patent
Fore

(10) Patent No.: US 10,589,920 B2
(45) Date of Patent: Mar. 17, 2020

(54) SYSTEM AND METHOD FOR A DISPENSER TO GENERATE DIFFERENT SPRAYS

(71) Applicant: Precision Valve Corporation, Rye Brook, NY (US)

(72) Inventor: John B. Fore, Travelers Rest, SC (US)

(73) Assignee: PRECISION VALVE CORPORATION, Greenville, SC (US)

( * ) Notice: Subject to any disclaimer, the term of this patent is extended or adjusted under 35 U.S.C. 154(b) by 0 days.

(21) Appl. No.: 15/265,988

(22) Filed: Sep. 15, 2016

(65) Prior Publication Data

US 2018/0072485 A1 Mar. 15, 2018

(51) Int. Cl.

| | |
|---|---|
| ***B65D 83/48*** | (2006.01) |
| ***B65D 83/20*** | (2006.01) |
| ***B05B 1/30*** | (2006.01) |
| ***B65D 83/46*** | (2006.01) |
| *B05B 11/00* | (2006.01) |
| *B65D 83/22* | (2006.01) |

(52) U.S. Cl.

CPC ..... *B65D 83/205* (2013.01); *B05B 1/30* (2013.01); *B65D 83/46* (2013.01); *B65D 83/48* (2013.01); *B05B 11/3005* (2013.01); *B65D 83/22* (2013.01)

(58) Field of Classification Search

CPC .... B65D 83/205; B65D 83/48; B65D 83/753; B05B 1/30; B05B 11/3005

USPC ..... 239/1

See application file for complete search history.

(56) References Cited

U.S. PATENT DOCUMENTS

| | | | |
|---|---|---|---|
| 2,598,308 | A | 5/1952 | Samuels |
| 2,887,273 | A | 5/1959 | Anderson |
| 3,191,816 | A | 6/1965 | Fead |
| 3,191,817 | A | 6/1965 | Furutani |
| 3,195,569 | A | 7/1965 | Seaquist |

(Continued)

FOREIGN PATENT DOCUMENTS

| | | |
|---|---|---|
| EP | 1024094 A1 | 8/2000 |
| JP | 7-251883 | 10/1995 |

(Continued)

OTHER PUBLICATIONS

Extended European Search Report dated Feb. 8, 2018 from corresponding European Patent Application No. 17184816.1, 10 pages.

(Continued)

*Primary Examiner* — Chee-Chong Lee

(74) *Attorney, Agent, or Firm* — Ohlandt, Greeley, Ruggiero & Perle, L.L.P.

(57) ABSTRACT

A system releases spray fluid in different mass flow rates. The system includes an actuator having a first area and a second area, a stem connected to the actuator and having a first orifice and a second orifice, a gasket covering the first orifice and the second orifice in a non-actuated position, and a biased member biasing the stem to the non-actuated position. When the first area of the actuator is pressed, the stem moves a first distance relative to the gasket to uncover the second orifice and compressing the biased member to spray fluid with a first mass flow rate. When the second area of the actuator is pressed, the stem moves a second distance relative to the gasket to uncover the first orifice and the second orifice to spray fluid with a second mass flow rate greater than the first mass flow rate.

23 Claims, 16 Drawing Sheets

(56) References Cited

U.S. PATENT DOCUMENTS

| | | | | |
|---|---|---|---|---|
| 3,206,082 | A | 9/1965 | Green | |
| 3,209,960 | A | 10/1965 | Green | |
| 3,292,827 | A | 12/1966 | Frangos | |
| 3,344,961 | A * | 10/1967 | Graham | B65D 83/46 222/402.22 |
| 3,363,968 | A * | 1/1968 | Williams | B65D 83/205 132/290 |
| 3,653,558 | A | 4/1972 | Shay | |
| 3,711,030 | A | 1/1973 | Jones | |
| 3,795,350 | A | 3/1974 | Shay | |
| 3,795,366 | A | 3/1974 | McGhie et al. | |
| 3,863,816 | A | 2/1975 | Focht | |
| 4,139,128 | A * | 2/1979 | Ewald | B65D 83/44 222/402.17 |
| 4,416,398 | A * | 11/1983 | Knickerbocker | B65D 83/206 222/402.13 |
| 5,971,230 | A | 10/1999 | Tanaka | |
| 6,039,306 | A | 3/2000 | Pericard et al. | |
| 6,129,247 | A | 10/2000 | Thomas et al. | |
| 6,296,155 | B1 * | 10/2001 | Smith | B65D 83/44 222/402.1 |
| 7,017,785 | B2 | 3/2006 | Lasserre et al. | |
| 7,036,691 | B2 | 5/2006 | Nicolas | |
| 7,104,424 | B2 | 9/2006 | Kolanus | |
| 7,104,427 | B2 | 9/2006 | Pericard et al. | |
| 7,364,055 | B2 | 4/2008 | Yquel et al. | |
| 7,487,891 | B2 | 2/2009 | Yerby et al. | |
| 7,651,003 | B2 | 1/2010 | Albers et al. | |
| 7,699,190 | B2 | 4/2010 | Hygema | |
| 7,757,905 | B2 | 7/2010 | Strand et al. | |
| 7,967,224 | B2 | 6/2011 | Belau et al. | |
| 7,984,827 | B2 | 7/2011 | Hygema | |
| 8,100,298 | B2 | 1/2012 | Marquardt et al. | |
| 8,127,968 | B2 | 3/2012 | Yerby et al. | |
| 8,286,830 | B2 | 10/2012 | Hygema | |
| 8,333,304 | B1 | 12/2012 | Haage | |
| 8,344,056 | B1 | 1/2013 | Tait et al. | |
| 8,418,892 | B2 | 4/2013 | Geier | |
| 8,517,227 | B2 | 8/2013 | Strand et al. | |
| 8,883,902 | B2 | 11/2014 | Tait et al. | |
| 9,205,973 | B2 | 12/2015 | Decea et al. | |
| 9,216,852 | B2 | 12/2015 | Cho et al. | |
| 9,260,237 | B2 | 2/2016 | Brace et al. | |
| 9,359,116 | B2 | 6/2016 | Beranger et al. | |
| 9,505,546 | B2 | 11/2016 | Arora et al. | |
| 9,511,926 | B2 | 12/2016 | Arora et al. | |
| 9,714,131 | B2 | 7/2017 | Arora et al. | |
| 9,758,295 | B2 | 9/2017 | Smith | |
| 2003/0071080 | A1 | 4/2003 | Yquel | |
| 2006/0201970 | A1 | 9/2006 | Jasek | |
| 2011/0259923 | A1 | 10/2011 | Chan et al. | |
| 2014/0138409 | A1 | 5/2014 | Beranger et al. | |
| 2014/0291353 | A1 | 10/2014 | Betts et al. | |
| 2015/0313662 | A1 | 11/2015 | Ottanelli | |
| 2016/0377231 | A1 | 12/2016 | Smith | |
| 2017/0233171 | A1 | 8/2017 | Christianson et al. | |

FOREIGN PATENT DOCUMENTS

| | | | |
|---|---|---|---|
| JP | 2014532599 | | 12/2014 |
| WO | 2009025697 | A1 | 2/2009 |
| WO | 2014080116 | A1 | 5/2014 |
| WO | WO2016170189 | A1 | 10/2016 |
| WO | WO2017067835 | A1 | 4/2017 |

OTHER PUBLICATIONS

Korean Office Action dated Jan. 3, 2019 in corresponding Korean Patent Application No. 10-2017-0111903, 16 pages.
Japanese Office Action dated Jan. 22, 2019 in corresponding Japanese Patent Application No. 2017-175760, 8 pages.
Taiwanese Office Action dated Dec. 28, 2018 in corresponding Taiwan Patent Application No. 106128778, 16 pages.

* cited by examiner

SYSTEM AND METHOD FOR A DISPENSER TO GENERATE DIFFERENT SPRAYS

BACKGROUND OF THE DISCLOSURE

1. Field of the Disclosure

The present disclosure relates generally to a spray system and a method to release a spray of fluid. More particularly, the present disclosure relates to a dispenser having a spray system and a method to generate selectively different sprays.

2. Description of Related Art

Conventionally, in a dispenser having an aerosol valve assembly, an actuator opens a valve to release product from an aerosol container by downwardly depressing the valve to generate a spray that exits the dispenser with a single mass flow rate. The conventional dispenser does not provide a user with the ability to selectively generate different sprays as desired. In particular, a user may desire a spray having a greater mass flow rate for some uses of the dispenser and a lesser mass flow rate for other uses.

Accordingly, there is a need for a dispenser having a system or a method that selectively generates different sprays of fluid exiting the dispenser.

SUMMARY OF THE DISCLOSURE

The present disclosure provides a system to release spray fluid in different mass flow rates.

The present disclosure also provides such a system that comprises an actuator; a stem connected to the actuator and having a channel surrounded by a wall, the stem having a first orifice and a second orifice through the wall; a gasket covering the first orifice and the second orifice in a non-actuated position; and a biased member that biases the stem to the non-actuated position.

The present disclosure further provides such a system in which the actuator has a first area and a second area, and when the first area of the actuator is pressed, the stem moves a first distance relative to the gasket uncovering the second orifice while the first orifice is covered by the gasket and compresses the biased member to spray fluid with a first mass flow rate, and when the second area of the actuator is pressed the stem moves a second distance relative to the gasket uncovering the first and second orifices and compressing the biased member to spray fluid with a second mass flow rate that is greater than the first mass flow rate.

The present disclosure still further provides such a system in which the first orifice is above the second orifice and the diameter of the first orifice is larger than the diameter of the second orifice.

The present disclosure also provides such a system that further comprises a level, and the actuator contacts sides of the level when the first area is pressed, and the actuator contacts the sides and rear of the level when the second area is pressed.

The present disclosure further provides such a system that further comprises a base that supports the actuator The present disclosure still further provides such a system in which the base has a first rib and a second rib and the actuator has a first indentation and a second indentation so that the actuator moves a first distance prior to the first indentation contacting the first rib when the first area of the actuator is pressed, and the actuator moves a second distance prior to the second indentation contacting the second rib when the second area of the actuator is pressed.

The present disclosure also provides a method to release spray fluid in a container in different mass flow rates, which method comprises: pressing one of a first area and a second area of an actuator to compress a biased member and move a stem having a first orifice and a second orifice with the stem having a gasket covering the first orifice and the second orifice in a non-actuated position.

The present disclosure further provides such a method in which when the first area of the actuator is pressed down, the stem moves a first distance relative to the gasket uncovering the second orifice while the first orifice is covered by the gasket to spray fluid with a first mass flow rate, and when the second area of the actuator is pressed down, the stem moves a second distance relative to the gasket uncovering the first orifice and the second orifice to spray fluid with a second mass flow rate that is greater than the first mass flow rate.

The present disclosure still further provides that actuator is supported by a base and the base has a first rib and a second rib and the actuator has a first indentation and a second indentation so that when the actuator moves the first distance prior to the first indentation contacting the first rib when the first area of the actuator is pressed and the actuator moves the second distance prior to the second indentation contacting the second rib when the second area of the actuator is pressed.

BRIEF DESCRIPTION OF THE DRAWINGS

FIG. 1(*b*) is a top, side perspective view of the dispenser of FIG. 1(*a*).

FIG. 3(*b*) is a bottom view of the actuator of FIG. 3(*a*).

FIG. 3(*c*) is a bottom, perspective view of the actuator of FIG. 3(*a*).

FIG. 4(*b*) is a cross-sectional view taken along lines 4-4 of the level of FIG. 4(*a*).

FIG. 4(*c*) is a front view of the level of FIG. 4(*a*).

FIG. 4(*d*) is a top, perspective view of the level of FIG. 4(*a*).

FIG. 5(*b*) is a top, perspective view of the base of FIG. 5(*a*).

FIG. 6(*b*) is a top, perspective view of the stem of FIG. 6(*a*).

FIG. 7(*b*) is a cross-sectional view taken along lines 7-7 of the insert of FIG. 7(*a*).

FIG. 8(*b*) is a side view of the cup of FIG. 8(*a*).

FIG. 8(*c*) is a top, perspective view of the cup of FIG. 8(*a*).

FIG. 9(*b*) is a cross-sectional view of the housing of FIG. 9(*a*).

FIG. 9(*c*) is a top, perspective view of the insert of FIG. 9(*a*) shown as transparent.

FIG. 10(*b*) is a top, perspective view of the container of FIG. 10(*a*).

FIG. 11(*b*) is a side cross-sectional view of the dispenser of FIG. 1(*a*) in the non-actuated position.

FIG. 12 (*b*) is a side cross-sectional view of the dispenser of FIG. 1(*a*) in a spray-less position.

DETAILED DESCRIPTION OF THE DISCLOSURE

Figure 1B:
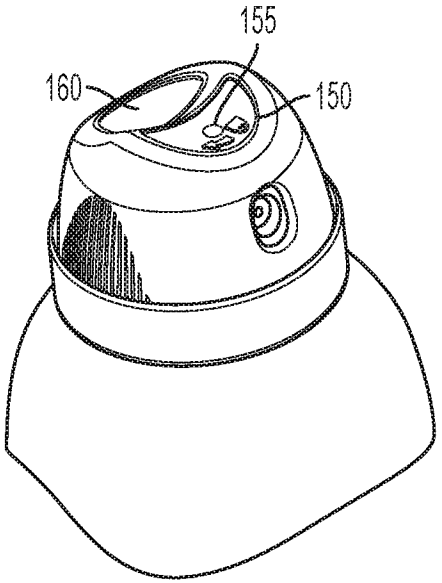
FIG. 1(*a*) is a front view of a dispenser according to the present disclosure.
Figure 1A:
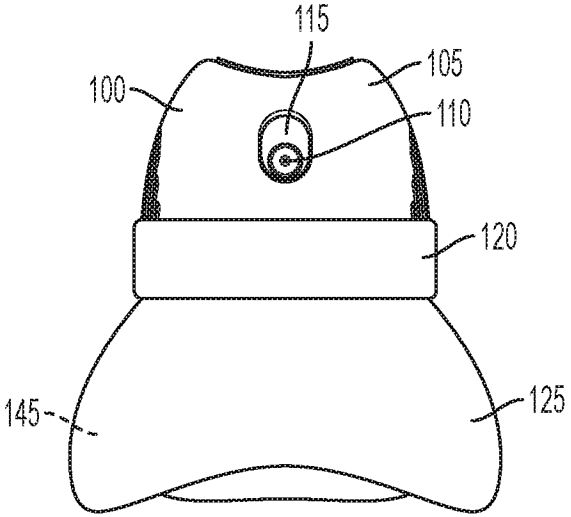

Referring to the drawings and, in particular, to FIG. 1(*a*), there is provided a dispenser according to the present disclosure generally represented by reference numeral 100. Dispenser 100 comprises an actuator 105, an insert 110 positioned in the actuator, a spray level 115, a base 120 upon which the actuator is mounted for use, and a container 125 connected to the base.

Container 125 can store spray fluid 145. Spray fluid 145 in container 125 is pressurized, or can be pressurized before and/or after being filled in container 125. After spray fluid 145 is pressurized, the pressure of spray fluid 145 in container 125 is higher than the ambient pressure.

Referring to FIG. 1(*b*), actuator 105 has a top portion 150. Top portion 150 has a first area 155 and a second area 160.

Figure 2:
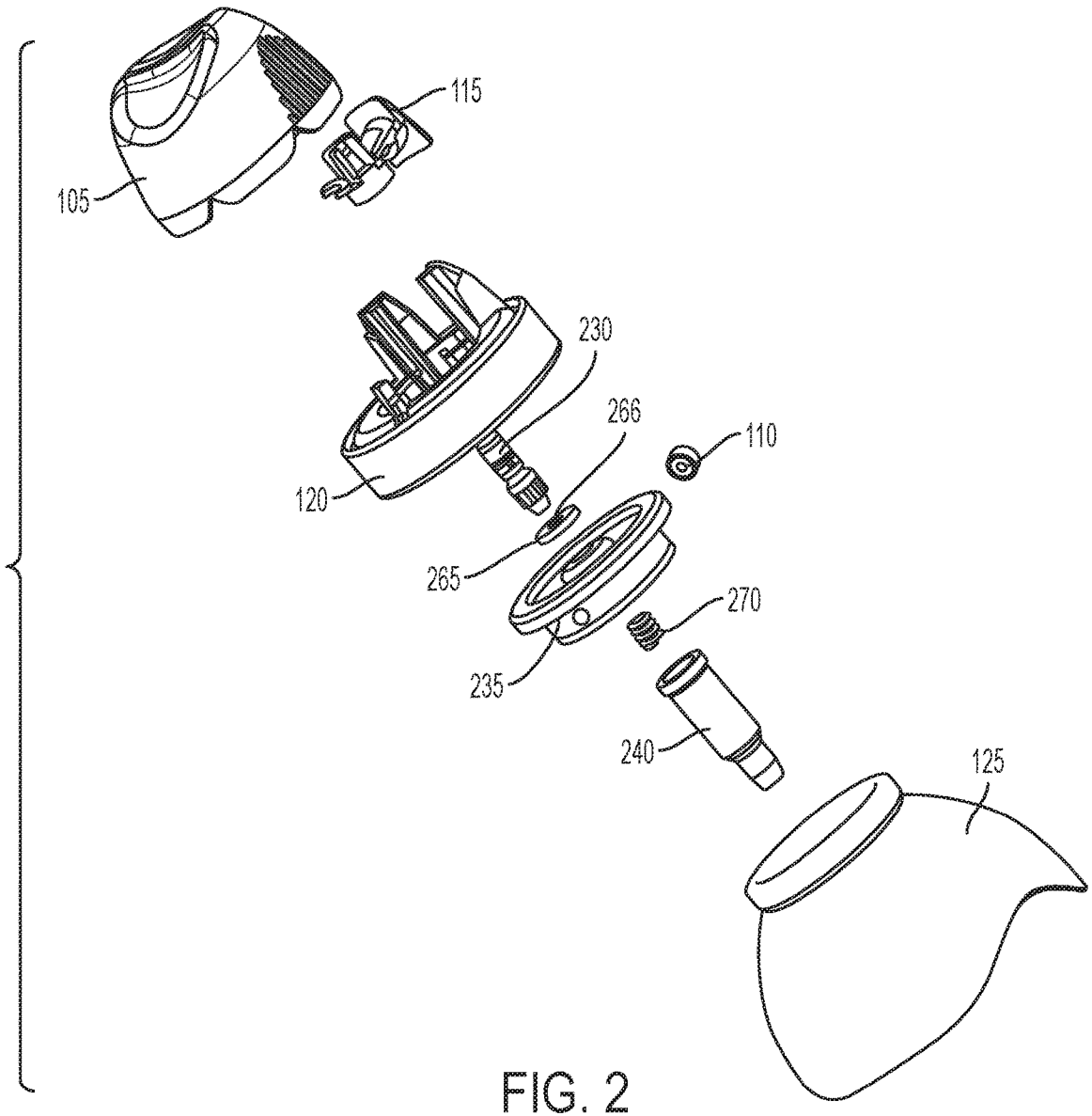
FIG. 2 is an exploded view of the dispenser of FIG. 1(*a*).

Referring to FIG. 2, dispenser 100 has a stem 230 that can be positioned in base 120, a cup 235 that is positioned about the stem, a housing 240 that fits about the stem, a stem gasket 265 and a biased member 270 about the stem and in the housing. Stem gasket 265 has a bottom surface, a top surface and a center opening 266. Stem gasket 265 is made of a flexible material and impermeable to spray fluid 145.

Biased member 270 can be a spring. Biased member 270 can be made of a metal material.

Figure 3C:
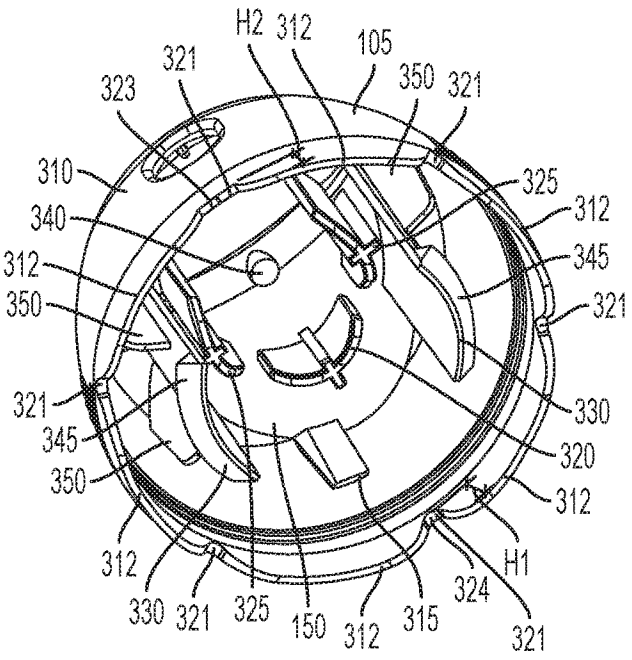
FIG. 3(*a*) is a top view of an actuator of the dispenser of FIG. 1(*a*).
Figure 3A:
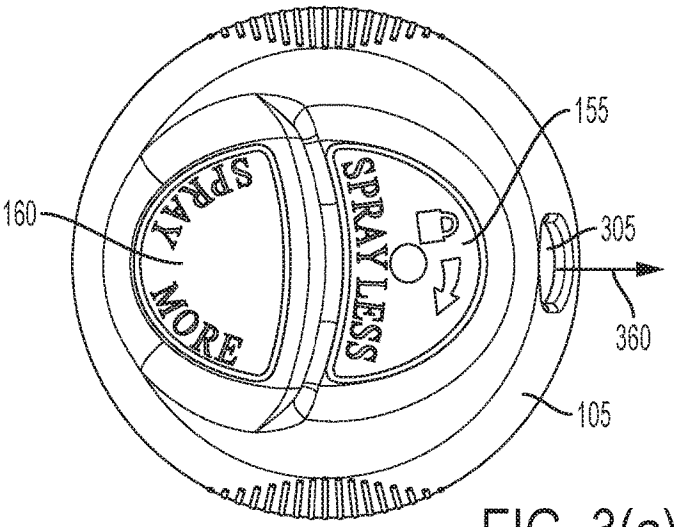
Figure 3B:
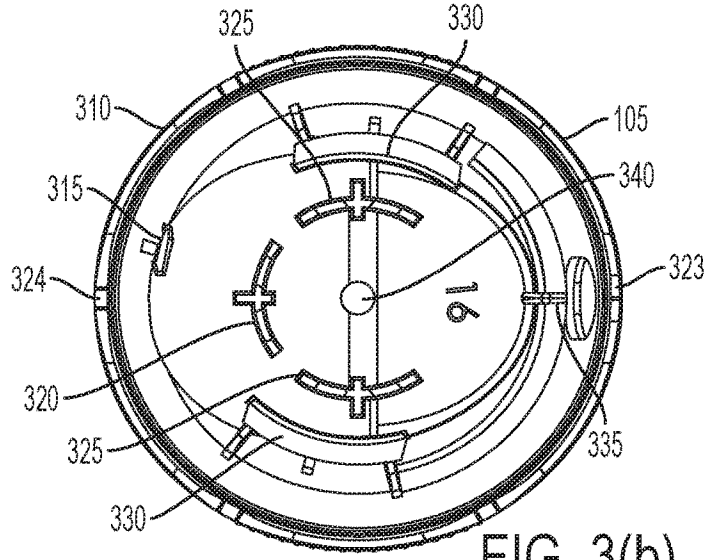
Figure 4A:
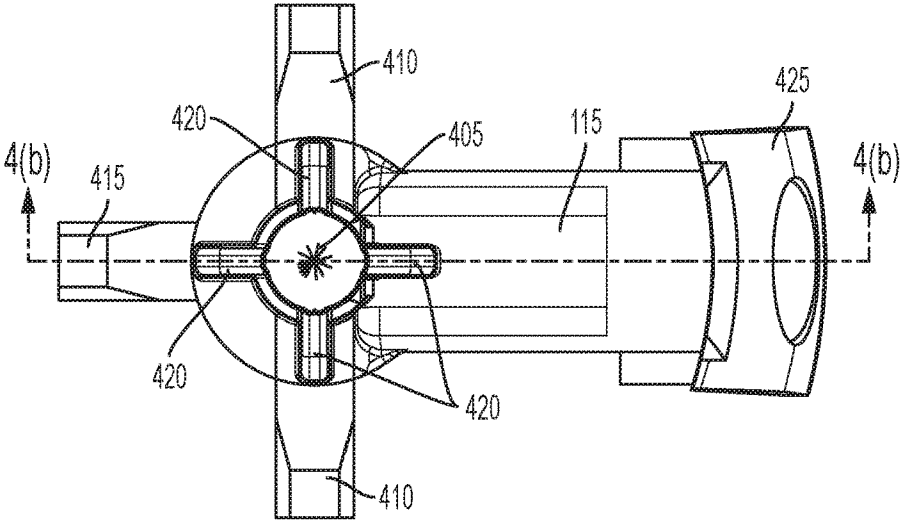
FIG. 4(*a*) is a top view of a level of the dispenser of FIG. 1(*a*).
Figure 4B:
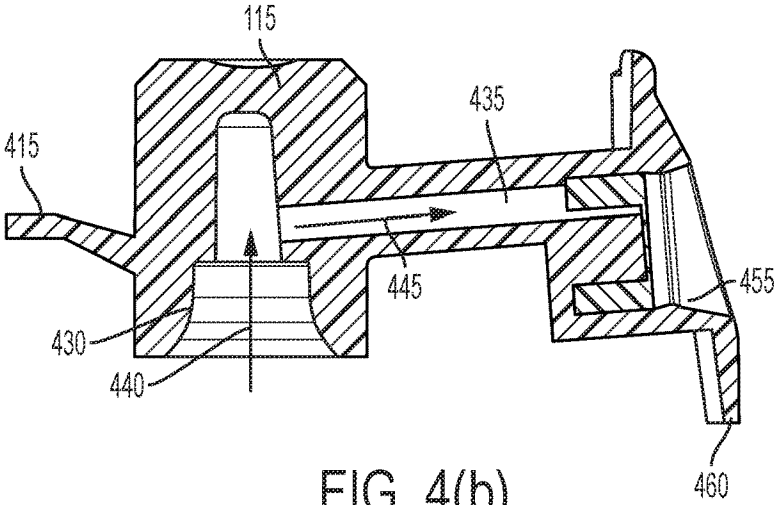
Figure 4C:
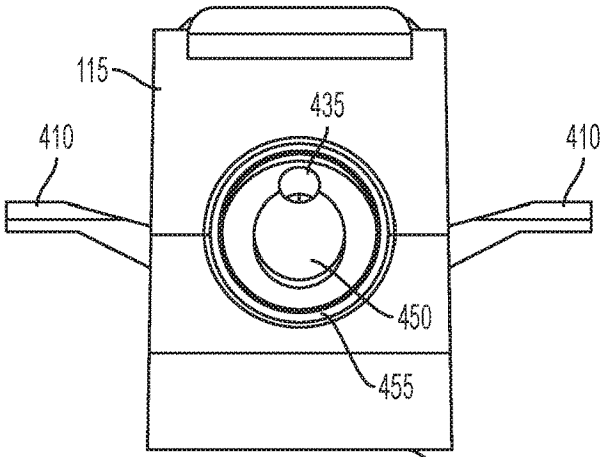
Figure 4D:
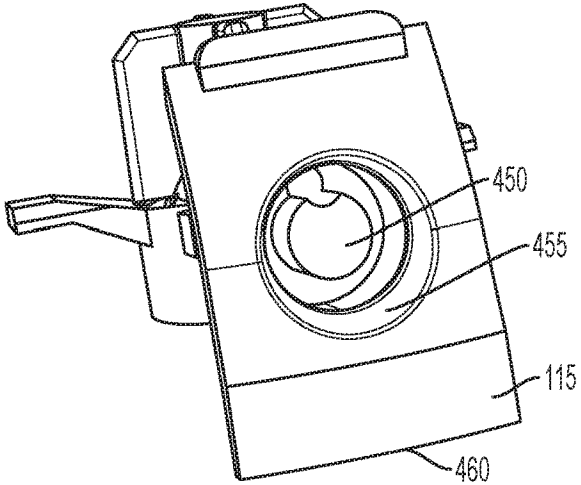

Referring to FIG. 3(*a*), actuator 105 has an opening aperture 305. Insert 110 is located inside opening aperture 305 and the opening aperture has a dimension larger than that of the insert, as shown in FIG. 1(*a*) and FIG. 1(*b*). Spray fluid 145 is released from insert 110 along an arrow direction 360.

Referring to FIG. 3(*b*), actuator 105 further comprises a shell 310, a rear extension 315 inside the shell 310, an inner rear extension 320 distanced from and positioned further radially inward than rear extension 315, and a pair of inner side extensions 325 that circumferentially align with inner rear extension. Actuator 105 also has a pair of outer side extensions 330, a front extension 335 and a center rod 340 that are connected to shell 310.

Referring to FIG. 3(*c*), shell 310 has a plurality of spaced curved indentations 321 about a lower periphery thereof. Each adjacent pair of curved indentations 321 defines one peripheral segment 312 therebetween. One curved indentation 321 is a front indentation 323 that is located below aperture 305, and another of curved indentation is a rear indentation 324 that is located on an opposite side of shell 310. Rear indentation 324 has a height H1 that is greater than a height H2 of front indentation 323.

Rear extension 315, inner rear extension 320, pair of inner side extensions 325, pair of outer side extensions 330, and front extension 335 all extend from top portion 150 of actuator 105 and actually from shell 310.

Rear extension 315, inner rear extension 320, and each inner side extension 325 and outer side extension 330 are radially inward and coaxial or substantially coaxial with the outer periphery of shell 310.

As shown in FIG. 3(*b*), inner rear extension 320 and each inner side extension 325 are along a same radius. The center of inner rear extension 320 is spaced at an angle of 45 degrees from the centers of each inner side extension 325. Also, the centers of each inner side extension 325 are 180 degrees apart from one another.

Two outer side extensions 330 are located along the same radii and those radii are greater than the radii of inner side extensions 325. As with inner side extensions 325, the centers outer side extensions 330 are 180 degrees apart from one another. Also, outer side extensions 330 are longer than inner side extensions 325.

Front extension 335 is located radially inward with respect to the radial position of aperture 305.

Referring to FIG. 3(*c*), each outer side extension 330 has a hook 345 and a plurality of ribs 350 to support outer side extension 330. Each hook 345 is located on the end of outer side extension 330.

Referring to FIG. 4(*a*), level 115 has a center portion 405, a pair of side surfaces 410 spaced radially outer therefrom, a rear surface 415 also spaced radially outer from the center portion and between the pair of side surfaces, four ribs 420 equally spaced circumferentially around center portion 405, and a shell surface 425.

Referring to FIGS. 4(*c*) and 4(*d*), level 115 further comprises a center rod 450 and an opening aperture 455. Center rod 450 and opening aperture 455 are configured to receive insert 110 and to mount insert 110 on level 115. Opening aperture 455 is surrounded by faceplate 460. Center rod 450 is located below channel 435.

Referring to FIG. 4(*b*), spray fluid 145 enters a vertical channel 430 along the direction of arrow 440. Spray fluid 145 then flows from vertical channel 430 to a channel 435 along the direction as indicated by arrow 445. Spray fluid 145 enters insert 110 in channel 435 before it is released.

Figure 5B:
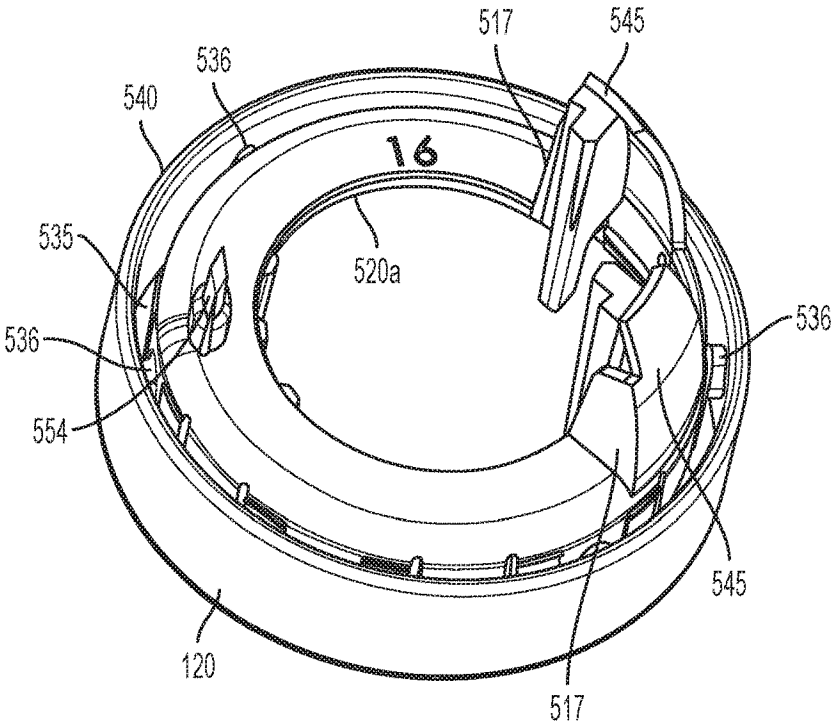
FIG. 5(*a*) is a bottom, perspective view of a base of the dispenser of FIG. 1(*a*).
Figure 5A:
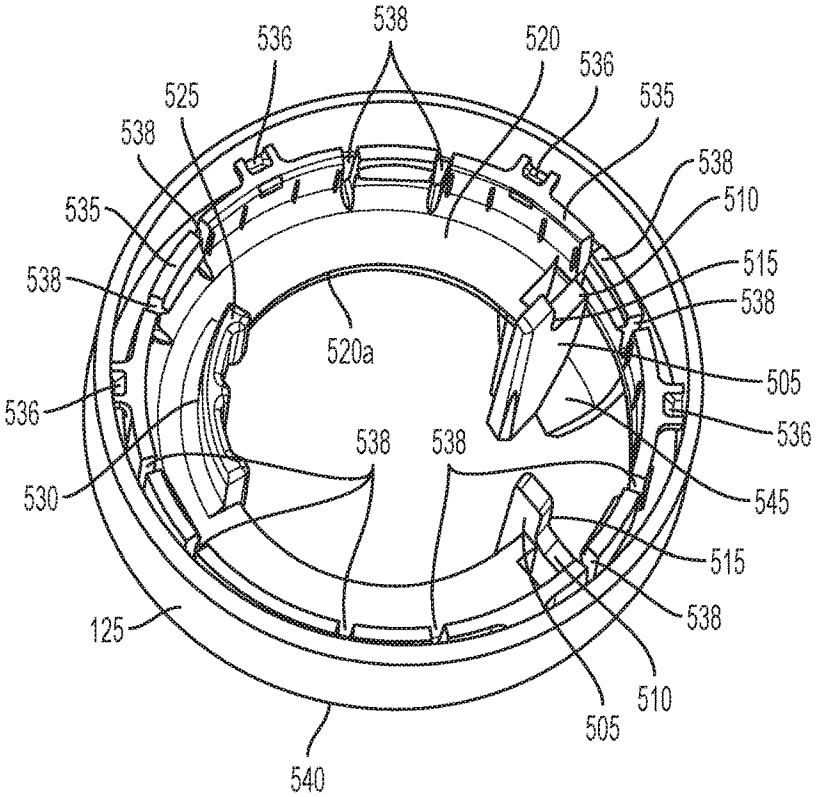

Referring to FIG. 5(*a*), base 120 has two front blocks 505, a flat surface 520 for connecting the two front blocks, a rear block 525 positioned on the flat surface between the two front blocks, an inner ring 535 connected to the flat surface and an outer or exterior ring 540. Each front block 505 has one vertical wall 515, one radial wall 517, and one circumferential wall 545. Rear block 525 has a vertical wall 530. One radial wall 517 is connected on a first side to one circumferential wall 545. One vertical wall 515 is connected on a second side, opposite the first side, to one circumferential wall 545.

Flat surface 520 has an upstanding clicking post 554. Inner ring 535 has spaces 538. Inner ring 535 is connected to outer ring 540 by a plurality of ribs 536.

Figure 6B:
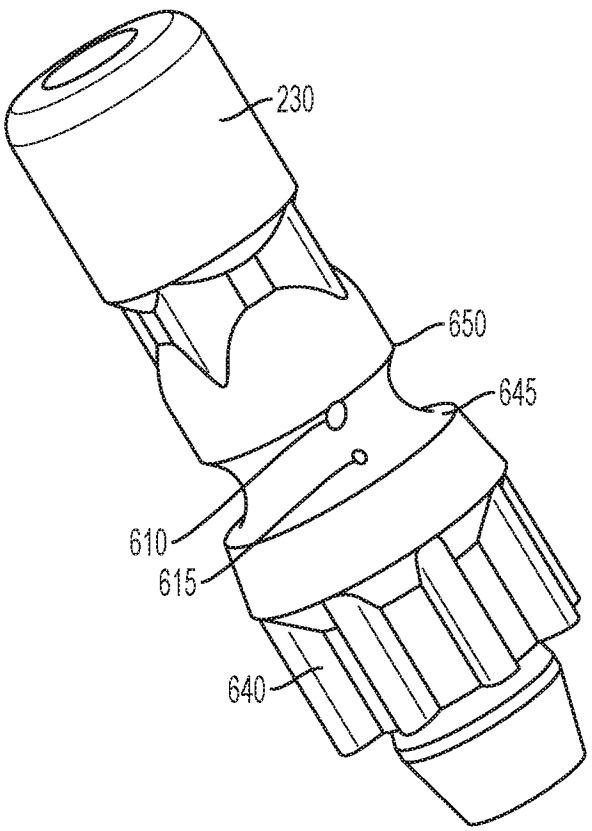
FIG. 6(*a*) is a cross-sectional view of a stem of the dispenser of FIG. 1(*a*).
Figure 6A:
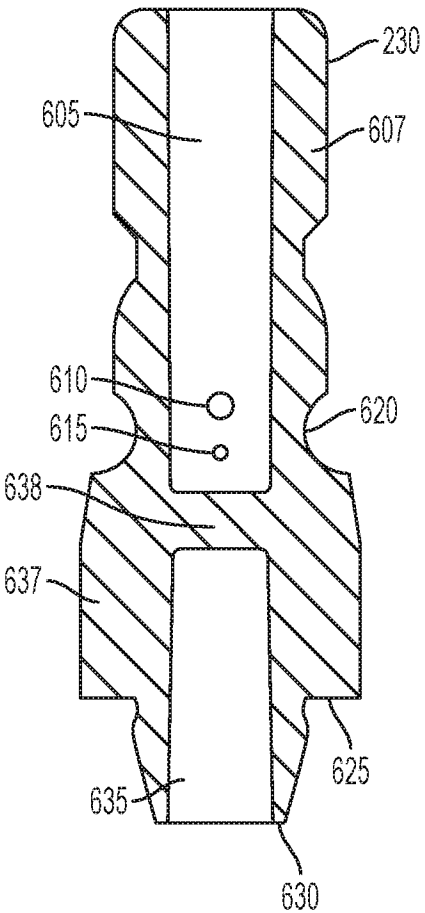

Referring to FIG. 6(*a*), stem 230 has a upper channel 605 surrounded by a first channel wall 607, a first orifice 610 in the upper channel, a second orifice 615 in the upper channel below the first orifice, a groove surface 620, a shoulder surface 625, a bottom surface 630 and a lower channel 635 surrounded by a second channel wall 637. First orifice 610 and second orifice 615 are through channel wall 607. Upper channel 605 and lower channel 635 are separated by a separation wall 638.

First orifice 610 has a hole diameter that can be larger than that of second orifice 615. An exemplary diameter of first orifice 610 is 0.46 millimeters (mm). An exemplary diameter of second orifice 615 is 0.25 mm.

Referring to FIG. 6(*b*), stem 230 also has a plurality of ribs 640 equally spaced around stem 230. Ribs 640 are to provide flow channels.

As shown in FIG. 6(*b*), groove 620 has a lower edge 645 and an upper edge 650. Both first orifice 610 and second orifice 615 are located between lower edge 645 and upper edge 650.

Figure 7B:
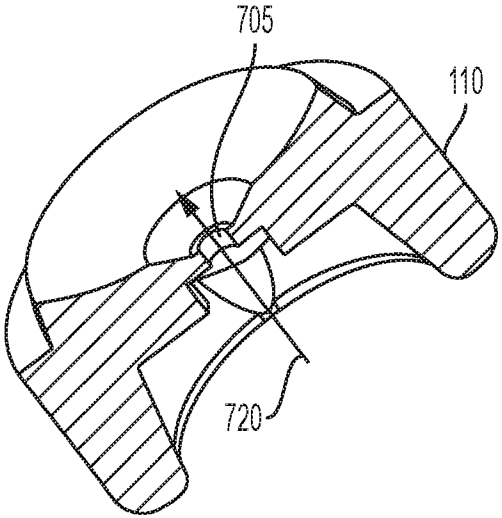
FIG. 7(*a*) is a top, perspective view of an insert of the dispenser of FIG. 1(*a*).
Figure 7A:
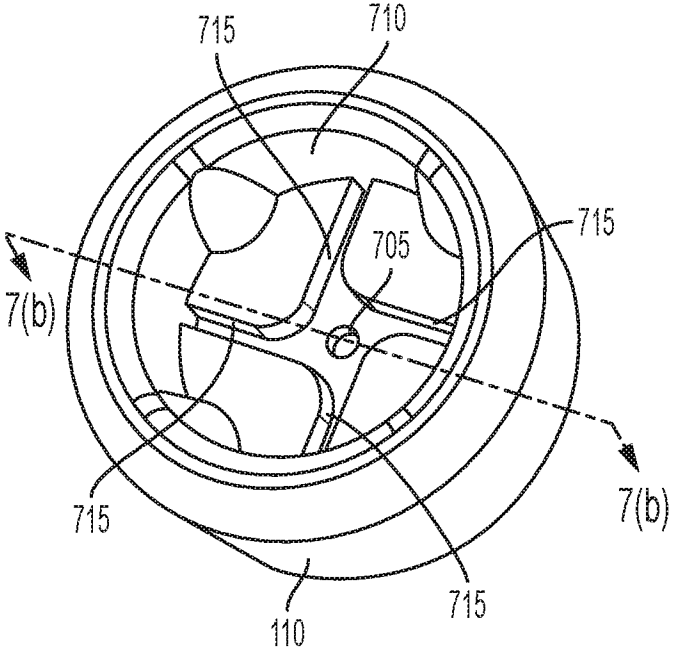

Referring to FIG. 7(*a*), insert 110 has an opening 710, four flow channels 715 to mix spray fluid 145 from channel 435 of level 115, and one exit nozzle 705. The number of flow channels 715 can be two, three or four. Spray fluid 145 exits from exit nozzle 705 of insert 110 along an arrow direction 720, as shown in FIG. 7(*b*).

Figure 8C:
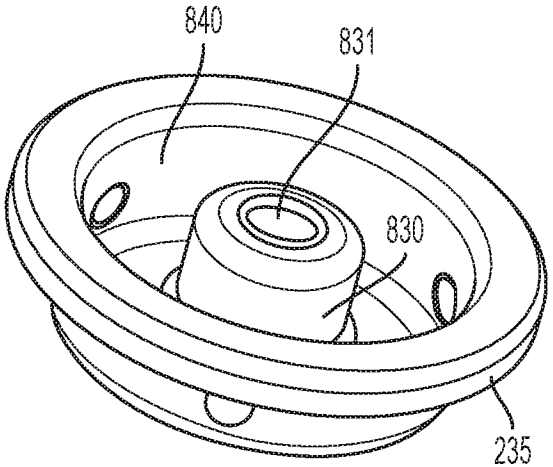
FIG. 8(*a*) is a cross-sectional view of a cup of the dispenser of FIG. 1(*a*).
Figure 8A:
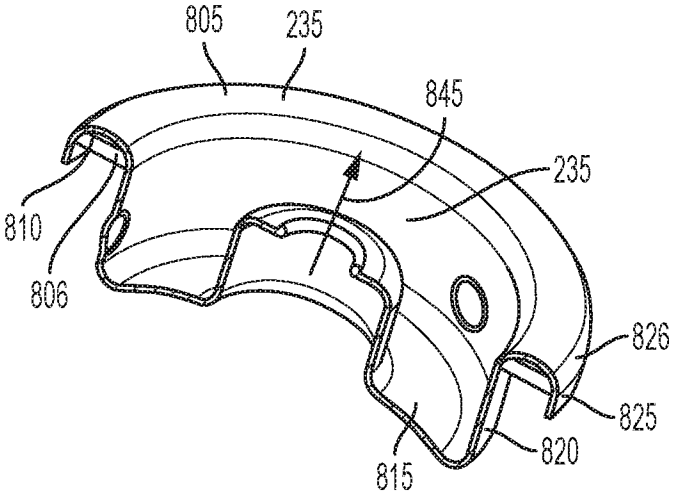
Figure 8B:
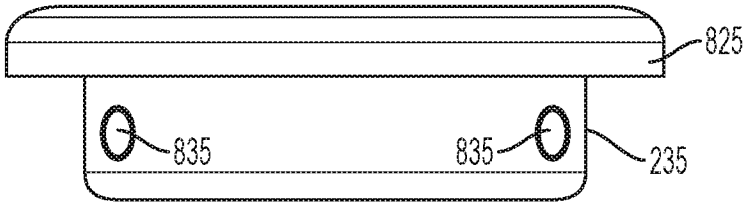

Referring to FIGS. 8(*a*) to 8(*c*), cup 235 has a top wall 805 that forms a u-shaped channel 810 and a plate 806, a bottom wall 815, an inner wall 820 having an inner wall surface 840, and an outer wall 826 with an outer edge 825. Cup 235 also has a bushing 830 having a bushing opening 831 and three apertures 835 equally spaced around bushing 830. Aperture 835 retains cup 235 to container 125 as the container 125 travels down to the assembly line before cup 235 is finally crimped to a fixed position. Spray fluid 145 from container 125 flows along an arrow direction 845.

Figure 9C:
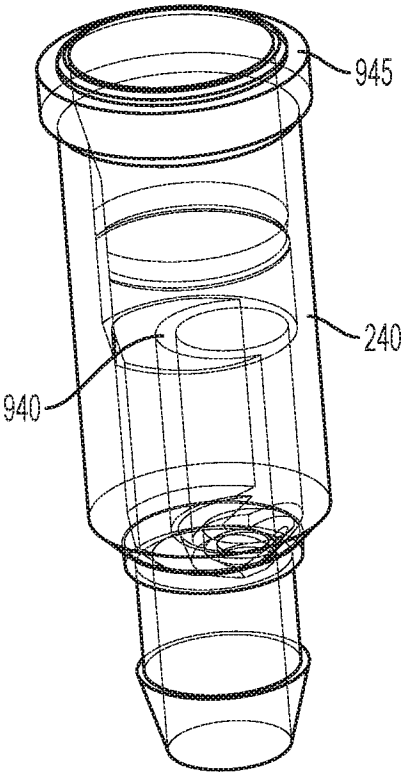
FIG. 9(*a*) is a top view of a housing of the dispenser of FIG. 1(*a*).
Figure 9B:
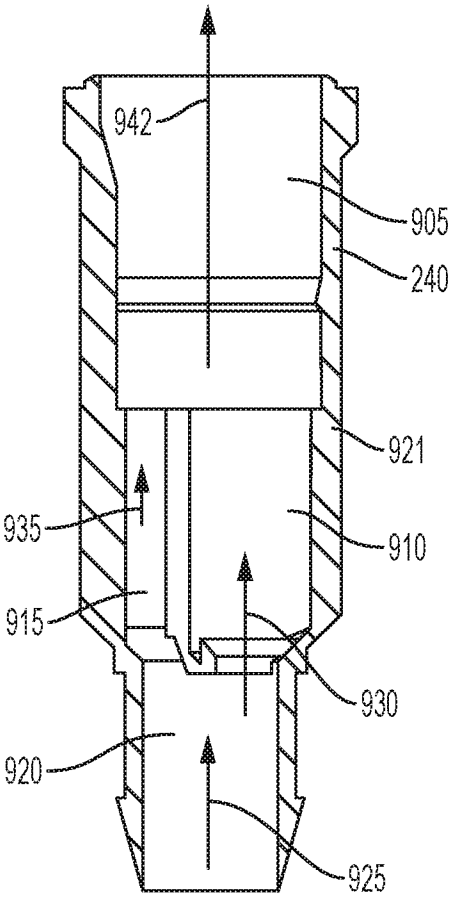
Figure 9A:
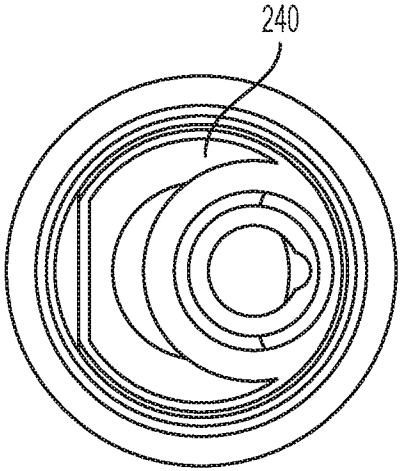

Referring to FIGS. 9(*a*) and 9(*b*), housing 240 has an upper channel 905, two middle flow channels 910 and 915 and a low fluid channel 920 surrounded by housing wall 921. Spray fluid 145 flows from container 125 and enters lower flow channel 920 along a direction shown by arrow 925. In particular, a part of spray fluid 145 enters flow channel 915 along a direction shown by arrow 935 and the other part of spray fluid 145 enters flow channel 910 along a direction shown by arrow 930. Spray fluid 145 enters channel 905 and flows to stem 230 as shown by arrow 942. Referring to FIG. 9(*c*), housing 240 also has a shoulder surface 940 and a top surface 945.

Figure 10B:
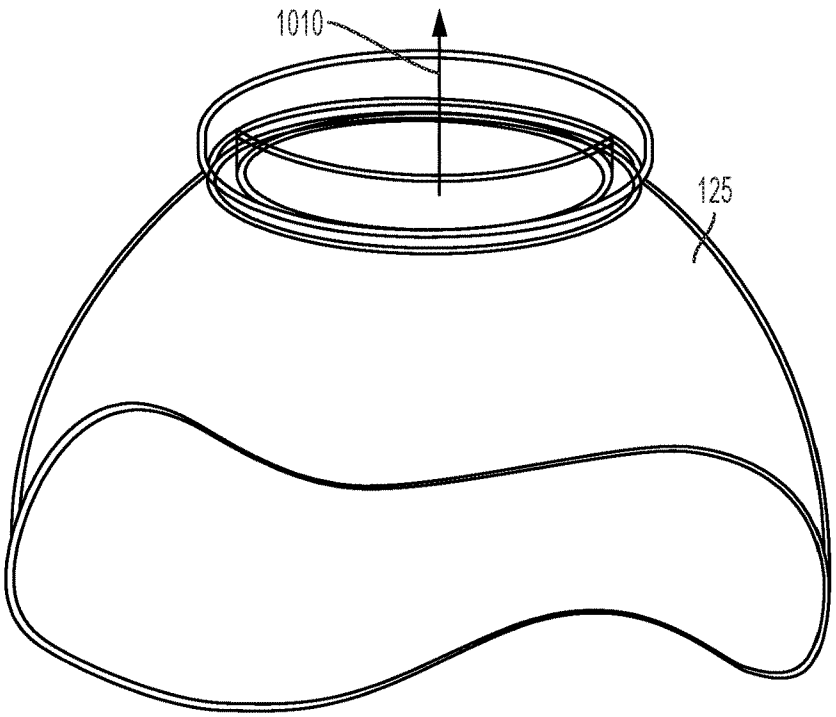
FIG. 10(*a*) is a cross-sectional view of a container of FIG. 1.
Figure 10A:
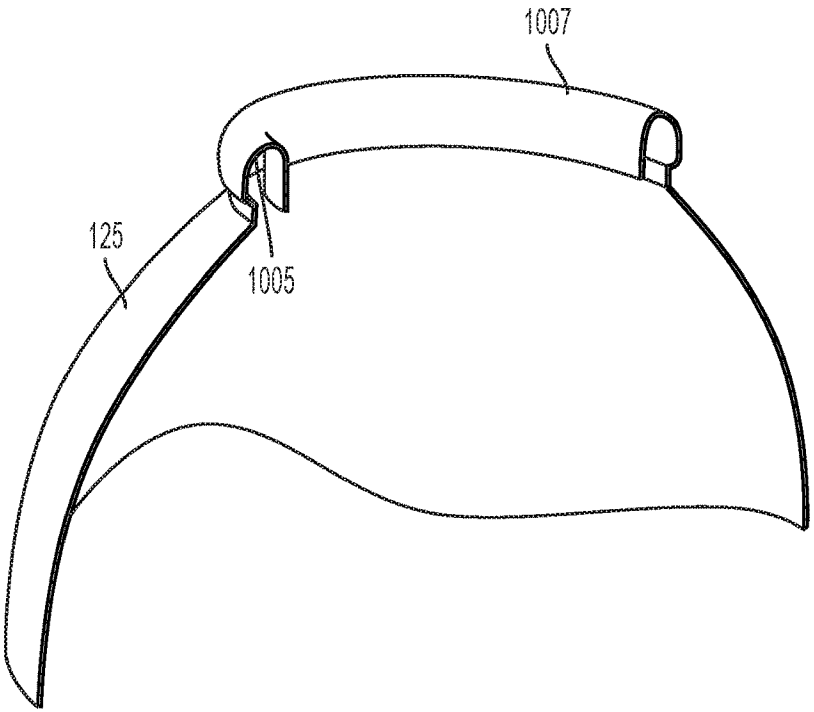

Referring to FIG. 10(*a*), container 125 has a u-shaped channel 1005 formed by an outer wall 1007. FIG. 10(*b*) shows spray fluid 145 leaving container 125 along a direction shown by arrow 1010.

Figure 11A:
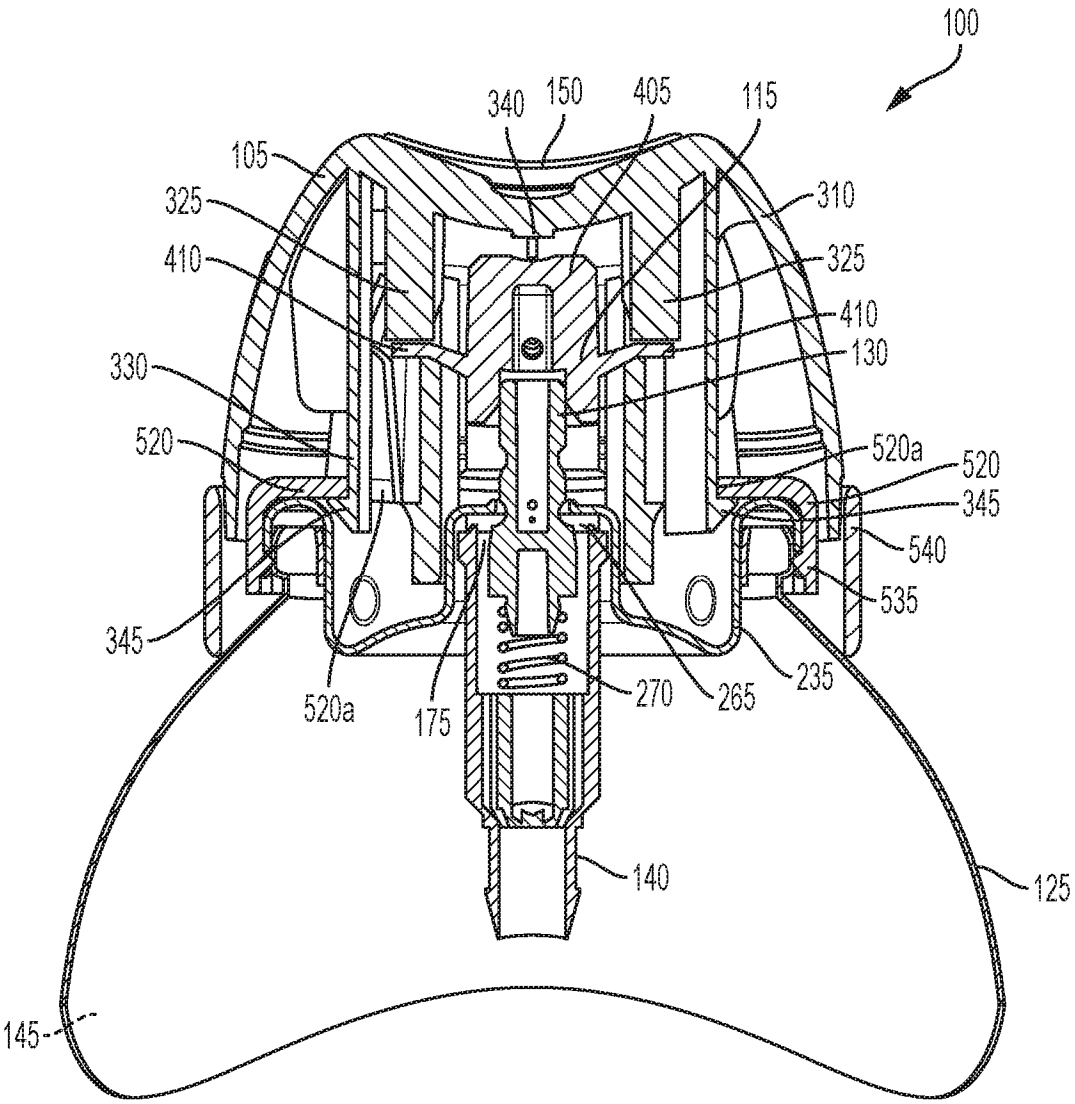
FIG. 11(*a*) is a rear cross-sectional view of the dispenser of FIG. 1(*a*) in a non-actuated position.
Figure 11B:
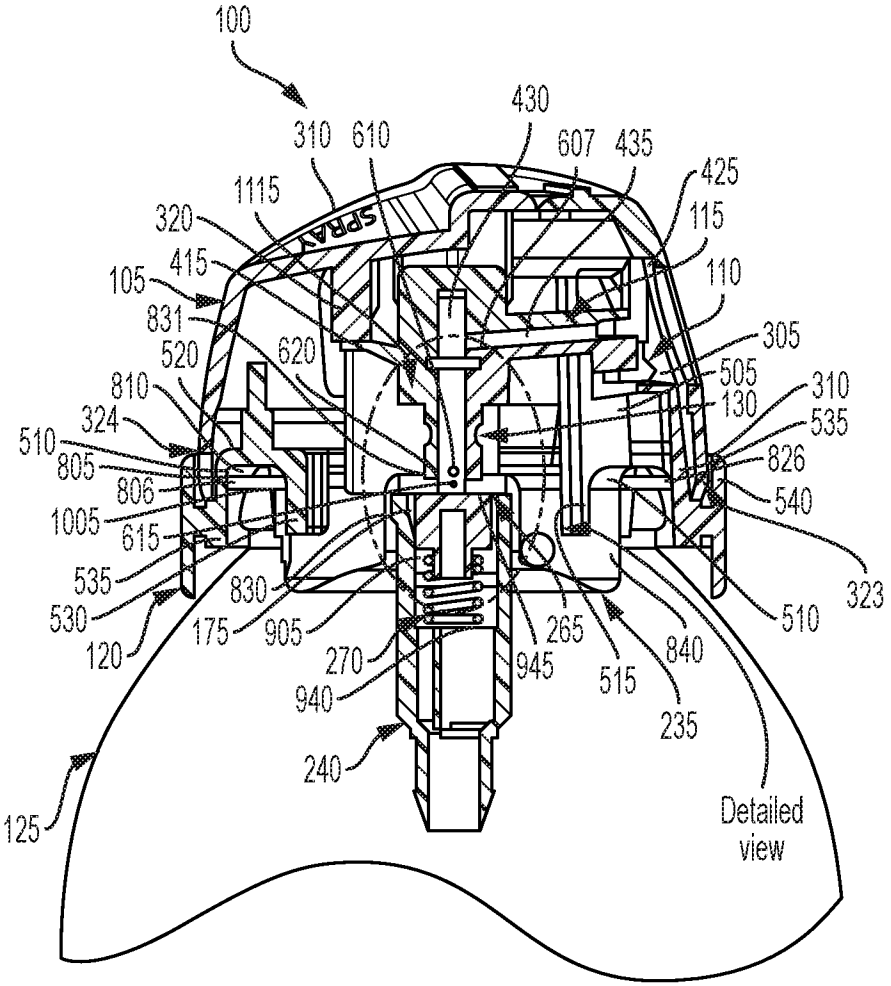

Referring to FIGS. 11(*a*) and 11(*b*), when system 100 is assembled, actuator 105 rests on top of base 120. Shell 310 of actuator 105 is located between outer ring 540 and inner ring 535 of base 120. Each hook 345 of actuator 105 snaps under an inner edge 520*a* of flat surface 520 when actuator 105 is connected to base 120 to thereby lock the actuator and base together while allowing relative rotation between the actuator and base.

Referring to FIG. 11 (*b*), inner rear extension 320 is in surface-to-surface contact with surface 415 of level 115 when system 100 is in a non-actuated position. Each inner side extension 325 is in a surface contact with surface 410 of level 115 when system 100 is in a non-actuated position. Front extension 335 is in a contact with shell surface 425 when system 100 is in a non-actuated position. Center rod 340 is aligned with a center portion 405 of level 115, as shown in FIG. 11(*a*). Faceplate 460 covers a space between insert 110 and shell 310. Faceplate 460 rests on inner ring 535 of base 120 so that level 115 pivots about inner ring 535. Center rod 450 and opening aperture 455 mount insert 110 on level 115 so that channel 435 of level 115, exit nozzle 705 of insert 110 and opening aperture 305 of actuator 105 can be aligned. Surface 425 of level 115 is equally or substantially equally spaced between circumferential walls 545.

As shown clearly in FIG. 11(*a*), base 120 connects to cup 235. AS shown in FIG. 11(*b*), vertical surfaces 515 and vertical surface 530 of base 120 are in surface-to-surface contact with an inner side surface 840 of cup 235. Each horizontal flat surface 510 has the same height to flat surface 520 and is in surface-to-surface contact with a top surface 805 of cup 235. Spaces 538 allow for flexibility of inner ring 535 during assembly with top surface 805 and contact the outer wall 826 of cup 235.

Stem 230 is inserted into center opening 266 of stem gasket 265 so that stem gasket 265 is inserted in groove surface 620. First orifice 610 and second orifice 615 are sealed by stem gasket 265 when system 100 is in a non-actuated position, as shown in FIG. 11(*b*), so that spray fluid 145 cannot enter first orifice 610 and second orifice 615. Stem 230 is inserted into bushing opening 831 of cup 235 and channel wall 607 is inserted into channel 430 to connect stem 230 to level 115.

As shown in FIG. 11(*a*), stem gasket 265 is secured between cup 235, housing 240 and stem 230 to seal a gap 175 between the stem gasket and stem. As shown in FIG. 11(*b*), biased member 270 pushes against housing 240 and stem 230 to bias the stem against level 115. Housing 240 is in bushing 830. Stem 230 can move up and down along upper channel 905 when system 100 is in a non-actuated position. Shoulder surface 940 is in contact with biased member 270. Specifically, biased member 270 rests on top of shoulder surface 940. Top surface 945 is in surface-to-surface contact with bottom surface of stem gasket 265. Specifically, stem gasket 265 sits on top of top surface 945. Housing 240 and gasket 265 are held by a cup crimp (not shown).

U-shaped channel 1005 is located inside of u-shaped channel 810 of cup 235. Both u-shaped channel 1005 of container 125 and u-shaped channel 810 of cup 235 are located inside of a first space formed by inner ring 535 and front block 505 and inside of a second space formed by inner ring 535 and rear block 525 forming a snap fit to secure base 120, container 125 and cup 235 together.

System 100 has the non-actuated position and two operation positions: a spray-less position and a spray-more position. Spray fluid 145 is not released from container 125 in the non-actuated position. Spray fluid 145 can only be released in the spray-less position or the spray-more position.

A spray-less position means that system 100 releases spray fluid 145 in a mass flow rate less than a nominal mass flow rate of system 100. In the spray-less position, a user presses first area 155 to release spray fluid 145 from system 100.

Figure 13:
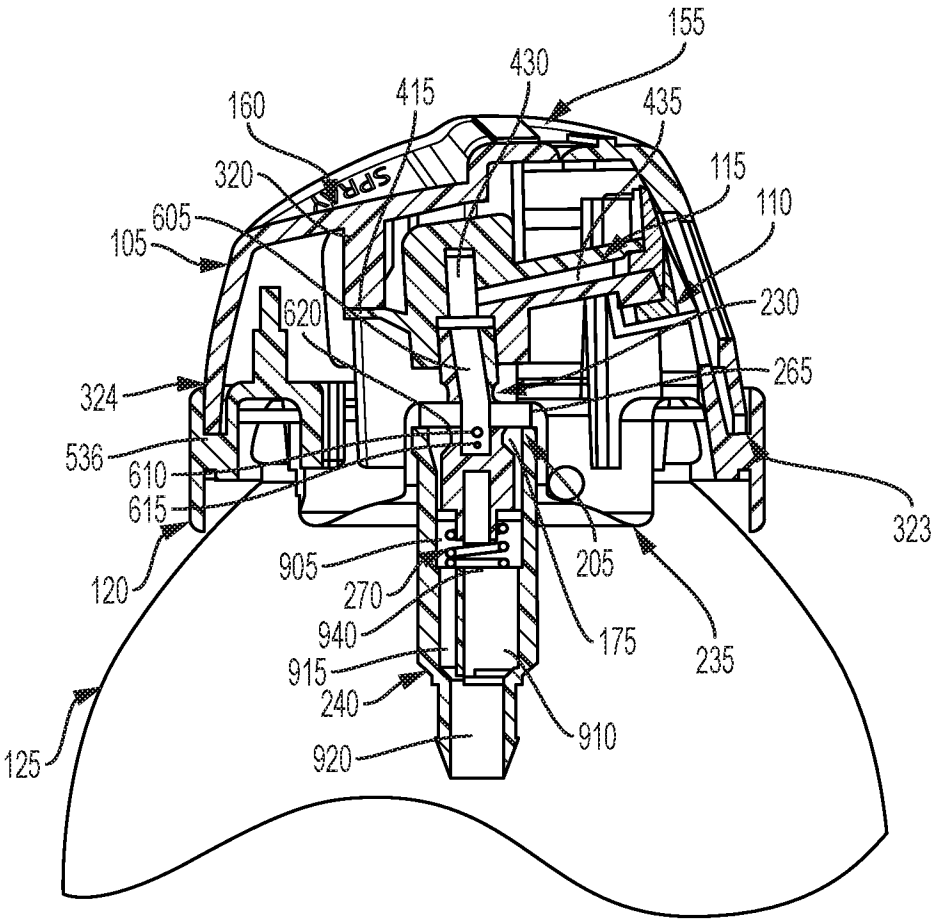
FIG. 13 is a cross-sectional view of the dispenser of FIG. 1(*a*) in a spray-more position.

In the spray-more position, a user presses second area 160, shown in FIG. 13, to release spray fluid 145 from system 100. The mass flow rate of the spray-more position is higher than the mass flow rate of the spray-less position.

Referring to FIG. 11(*b*), the system of FIG. 1(*a*) is shown in a non-actuated position. In the non-actuated position, no force is applied to actuator 105. First orifice 610 and second orifice 615 of stem 230 are above the bottom surface of stem gasket 265 or covered by the stem gasket. Accordingly, spray fluid 145 does not enter groove 620 of stem 230. In the non-actuated position, bottom of biased member 270 sits on top of shoulder surface 940 of housing 240, as described above. Biased member 270 pushes stem 230 up against stem gasket 265 so that both first orifice 610 and second orifice 615 are above the bottom surface of the stem gasket or covered by the stem gasket. Stem gasket 265 seals both first orifice 610 and second orifice 615, and blocks spray fluid 145 flowing from container 125 to insert 110.

Figure 12A:
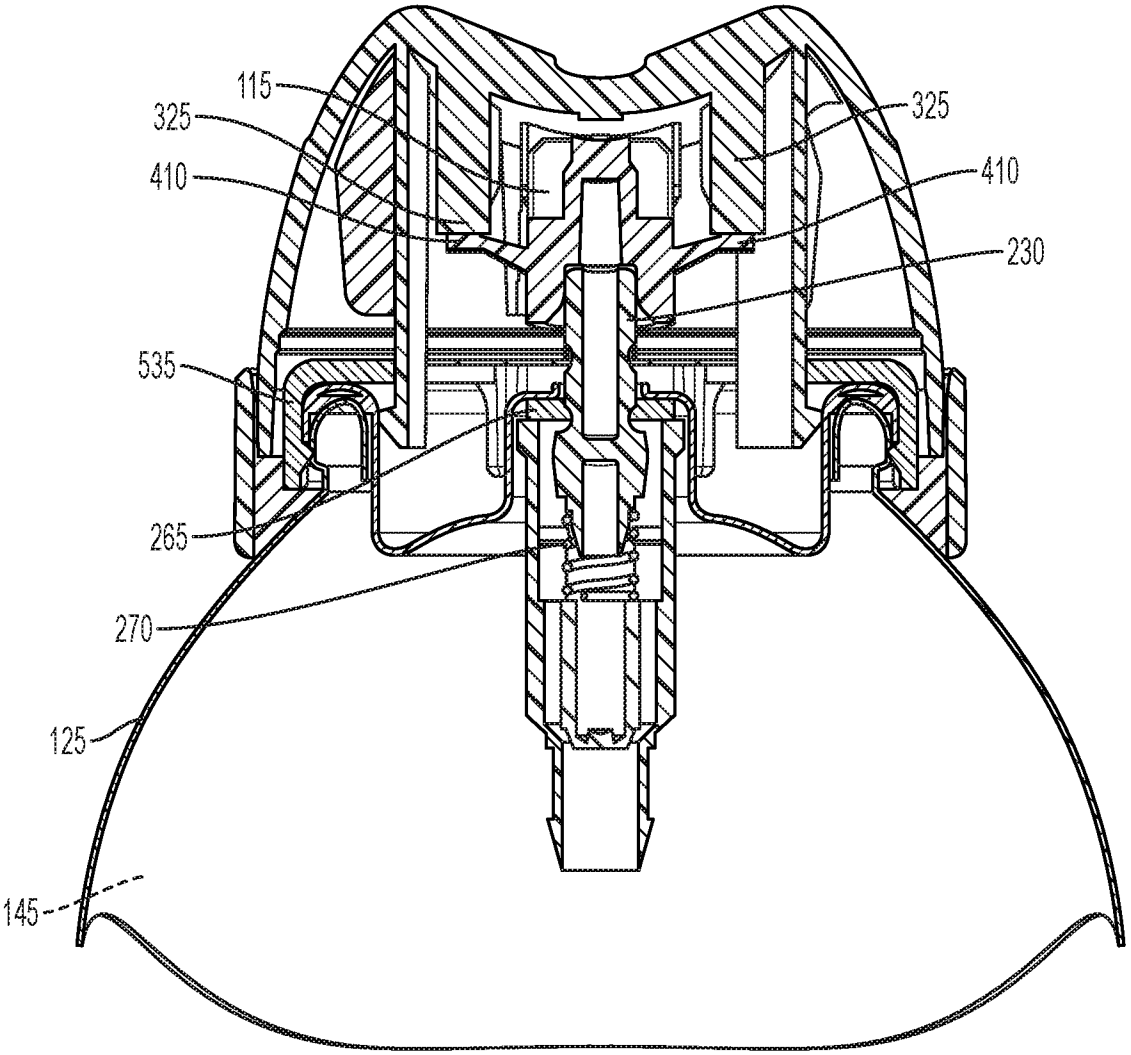
FIG. 12 (*a*) is a rear cross-sectional view of the dispenser of FIG. 1(*a*) in a spray-less position.
Figure 12B:
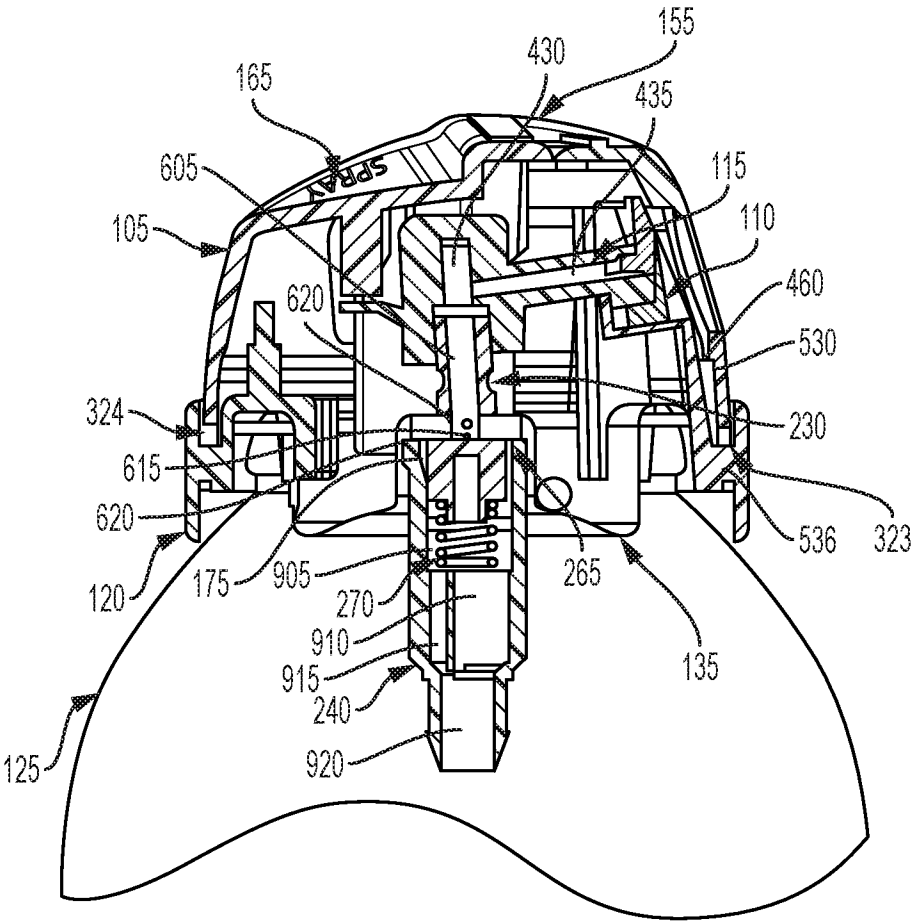

FIGS. 12 (*a*) and (*b*) show the system of FIG. 1(*a*) in a spray-less position. Referring to FIGS. 12(*a*) and 12(*b*), when force is applied to first area 155, two inner side extensions 325 are in direct contact with two surfaces 410 to pivot level 115 downward while faceplate 460 rests on inner ring 535 of base 120 and biased member 270 is compressed as stem 230 pushed downward. Actuator 105 is moved a distance equal to height H2 prior to front indentation 323 contacting one of plurality of ribs 536. Accordingly, second orifice 615 of stem 230 is below the bottom surface of stem gasket 265 while first orifice 610 is covered by stem gasket 265. Spray fluid 145 leaves container 125 through second orifice 615 because of a higher pressure in container 125 when spray fluid 145 is in communication with the ambient environment.

Referring to FIG. 12(*b*), spray fluid 145 enters housing 240 and goes through channels 920, 915, 910 and 905 of housing 240. After spray fluid 145 leaves housing 240, spray fluid 145 then enters groove 620 and subsequently enters second orifice 615. Spray fluid 145 continues to move upward into upper channel 605 of stem 230. After spray fluid 145 leaves stem 230, spray fluid 145 enters channel 430 and channel 435 of level 115. Spray fluid 145 enters four channels 715, and then enters opening 710 of insert 110. Accordingly, spray fluid 145 exits nozzle 705 of insert 110, Hole diameter of nozzle 705 can be from 0.025 mm to 2.5 mm. The hole diameter of nozzle 705 relates to spray characteristic required by formulation being sprayed.

FIG. 13 shows the system of FIG. 1(*a*) in a spray-more mode position. When another force is applied to second area 160, inner rear extension 320 of actuator 105 is in direct contact with surface 415 of level 115 to pivot the level downward while faceplate 460 rests on inner ring 535 of base 120, and biased member 270 is compressed and stem 230 is pushed down. Actuator 105 is moved a distance equal to height H1 (shown in FIG. 3(*c*)) prior to rear indentation 324 contacting another of plurality of ribs 536. Accordingly, both first orifice 610 and second orifice 615 of stem 230 are pushed down below the bottom surface of stem gasket 265.

As described above, spray fluid 145 in container 125 is pressurized or can be pressurized. Spray fluid 145 exits container 125 because of its higher pressure when spray fluid 145 is in communication with the ambient temperature.

Referring again to FIG. 13, spray fluid 145 enters housing 240 and goes through channels 920, 915 910, and 905 of housing 240. After spray fluid 145 leaves housing 240, spray fluid 145 then enters groove 620 and both first orifice 610 and second orifice 615. Spray fluid 145 continues to move upward in upper channel 605 of stem 230. After spray fluid 145 leaves stem 230, spray fluid 145 enters channel 430 and channel 435 of level 115. Again, before spray fluid 145 exits from nozzle 705 of insert 110, spray fluid 145 is mixed in four channels 715 before spray fluid 145 enters opening 710 of insert 110.

When system 100 is in a spray-less position, second orifice 615 is exposed to spray fluid 145 in container 125. Spray fluid 145 can enter stem 230 through second orifice 615, but spray fluid 145 cannot enter first orifice 610 because first orifice 610 is still sealed by gasket 265. When system 100 is in a spray-more position, both first orifice 610 and second orifice 615 are exposed to spray fluid 145 in container 125, and spray fluid 145 can enter stem 230 through second orifice 615.

Figure 14:
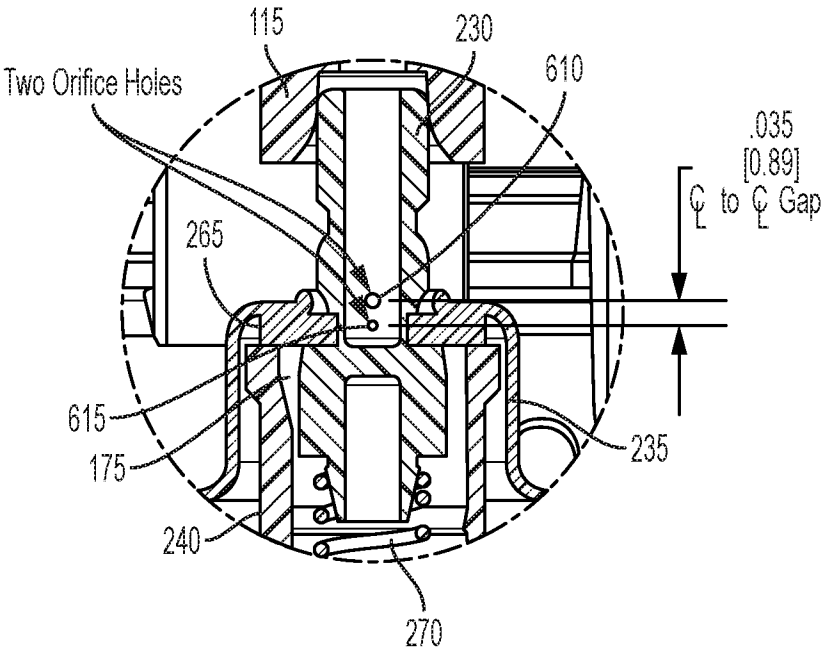
FIG. 14 is a detailed view of the dispenser of FIG. 11(*b*).

FIG. 14 shows a non-actuated position. As an embodiment of the present disclosure, the diameter of second orifice 615 is around 0.25 mm, and the diameter of first orifice 610 is 0.46 mm. As an embodiment of the present disclosure, the distance between first orifice and second orifice is about 0.035 inch (0.89 mm).

With the above orifices, mass flow rate for the spray-less is in the range of 0.3 to 0.5 grams per second. A mass flow rate for the spray-more position is in the range of 0.9 to 1.1 grams per second. Particularly, system 100 can achieve a mass flow rate having an average of 0.41 grams per second for the spray-less position and 0.98 grams per second for the spray-more with the above-mentioned embodiment.

The above-mentioned embodiment is one example of system 100. As understood by an ordinary skill in the art, the present disclosure can have other embodiments of system 100 that require different orifice sizes, shapes, spaces and number of orifices. System 100 preferably has the ability to prevent leakage, the ability to separate between the spray-less and spray-more function in mass flow rate, and the ability to match the customer's requested mass flow rates with their particular product. [[.]] There is no limitation to the shape of the orifice, the number of the orifice, the location of the orifice, or the distance between the orifices as long these desirable features can be met.

In the present disclosure, the spray-less position operation releases a less amount of spray fluid than that of spray-more position operation. No setting is required. The spray-more position distributes a normal or full amount of fluid spray. This spray-more position releases the same amount as any normal actuator and delivers a noticeable larger amount of spray than the spray-less position. Again, no settings are required.

In the present disclosure, the consumer simply moves their fingers from the front of system to the back of the system to switch between a spray-less and spray-more position operation.

The spray-less position is controllable in accordance with a manufacturer's requirements. The mass flow rate of the spray-less position can be as little as 80% reduction relative to the spray-more position. The variability of the two different mass flow rates of the spray-less position and the spray-more position can be infinite determined by the viscosity of the product and the pressure of aerosol in the container.

Actuator 105 is rotatable on base 120 from a closed position where actuator 105 cannot be depressed to dispense spray fluid 145 as shown in FIGS. 11(*a*) and 11(*b*) and an open position when actuator 105 can be operated in the spray-more position shown in FIG. 13 and the spray-less position shown in FIG. 12. When operated in the spray-more position and the spray-less position, actuator 105 can be vertically depressed by the consumer's finger whereby curved indentations 321 move downwardly over and bottom on ribs 536 on base 120, and peripheral segments 312 lie between ribs 536. The curved portions of curved indentations 321 guide ribs 536 and curved indentations 321 into full alignment with each other to establish the spray-more position and the spray-less position, and curved indentations 321 and ribs 536 stabilizes actuator 105 and base 120 during operation. When in the closed position, each of peripheral segments 312 sits on top of one of ribs 536 and actuator 105 cannot be vertically depressed relative to the base 120 so that no spray fluid 145 can be dispensed from system 100. Interference between one front block 505 and one outer side extension 330 restricts rotation of actuator 105 between the open position and the closed position.

During rotation of actuator 105 between the open position and the closed position, rear extension 315 contacts upstanding clicking post 554 generating an audible noise. The audible noise alerts a user that actuator 105 is rotating in a first direction to the open position or that actuator 105 is rotating in a second direction opposite the first direction away from the open position.

It should be noted that the terms "first", "second", and the like can be used herein to modify various elements. These modifiers do not imply a spatial, sequential or hierarchical order to the modified elements unless specifically stated.

While the present disclosure has been described with reference to one or more exemplary embodiments, it will be understood by those skilled in the art that various changes can be made and equivalents can be substituted for elements thereof without departing from the scope of the present disclosure. In addition, many modifications can be made to adapt a particular situation or material to the teachings of the disclosure without departing from the scope thereof. Therefore, it is intended that the present disclosure will not be limited to the particular embodiment(s) disclosed as the best mode contemplated, but that the disclosure will include all embodiments falling within the scope of the appended claims.

What is claimed is:

1. A system to release spray fluid in different mass flow rates from a container, the system comprising:

an actuator having a first area and a second area;

a stem being connected to the actuator and having a channel surrounded by a wall of the stem, the stem having a first orifice and a second orifice in communication with the channel through the wall, the wall of the stem having a groove that forms a neck around an exterior circumference of the stem;

a monolithic gasket seated in the groove and over the first orifice and the second orifice to directly seat the first orifice and the second orifice in a non-actuated position, the monolithic gasket held in place by the container; and a biased member that biases the stem to the non-actuated position, wherein the stem is movable a first distance relative to the gasket to directly uncover the second orifice while the first orifice is directly covered by the gasket and the stem compresses the biased member to spray fluid with a first mass flow rate when the first area of the actuator is pressed down, and wherein the stem is movable a second distance relative to the gasket to directly uncover the first orifice and the second orifice and the stem compresses the biased member to spray fluid with a second mass flow rate that is greater than the first mass flow rate when the second area of the actuator is pressed down.

2. The system according to claim 1, wherein the gasket is impermeable to spray fluid and seals the stem.

3. The system according to claim 1, wherein the first orifice is above the second orifice.

4. The system according to claim 3, wherein the first orifice has a diameter that is larger than the diameter of the second orifice.

5. The system according to claim 1, wherein the biased member is a spring.

6. The system according to claim 1, further comprising a level, wherein the actuator contacts sides of the level when the first area is pressed, and wherein the actuator contacts the sides and rear of the level when the second area is pressed.

7. The system according to claim 1, further comprising a base that rests on top of a container, wherein the base supports the actuator.

8. The system according to claim 7, wherein the actuator has side extensions with hooks that rotatably connect the base and the actuator.

9. The system according to claim 7, wherein the base has a first rib and a second rib and the actuator has a first indentation and a second indentation, wherein the actuator moves the first distance prior to the first indentation contacting the first rib when the first area of the actuator is pressed and the actuator moves the second distance prior to the second indentation contacting the second rib when the second area of the actuator is pressed.

10. The system according to claim 9, wherein the first distance is less than the second distance.

11. The system according to claim 1, wherein the first orifice and the second orifice each have a longitudinal axis that is positioned normal to the groove.

12. A method to release spray fluid from a container at different mass flow rates, the method comprising:

pressing one of a first area and a second area of an actuator to compress a biased member and move a stem of a dispensing system, the dispensing system having the actuator the stem, the biased member, and a monolithic gasket, wherein the stem is connected to the actuator and has a channel surrounded by a wall of the stem, wherein the stem has a first orifice and a second orifice in communication with the channel through the wall, and wherein the wall of the stem has a groove that forms a neck around an exterior circumference of the stem, wherein the monolithic gasket is seated in the groove and over the first orifice and the second orifice to directly seal the first orifice and the second orifice in a non-actuated position, wherein the monolithic gasket held in place by the container, wherein the biased member biases the stem to the non-actuated position, wherein the stem moves a first distance relative to the gasket to directly uncover the second orifice while the first orifice is covered by the gasket to spray fluid with a first mass flow rate when the first area of the actuator is pressed, and wherein the stem moves a second distance relative to the gasket to directly uncover the first orifice and the second orifice to spray fluid with a second mass flow rate that is greater than the first mass flow rate when the second area of the actuator is pressed.

13. The method according to claim 12, wherein the gasket is impermeable to spray fluid and seals the stem.

14. The method according to claim 12, wherein the second orifice is below the first orifice.

15. The method according to claim 14, wherein the first orifice has a diameter that is larger than the diameter of the second orifice.

16. The method according to claim 12, wherein the biased member is a spring.

17. The method according to claim 12, wherein the actuator contacts sides of a level when the first area is pressed, and wherein the actuator contacts the sides and rear of the level when the second area is pressed.

18. The method according to claim 17, wherein the actuator and the level are supported by a base that rests on top of the container.

19. The method according to claim 18, wherein the base has a first rib and a second rib and the actuator has a first indentation and a second indentation, wherein the actuator moves the first distance prior to the first indentation contacting the first rib when the first area of the actuator is pressed down and the actuator moves the second distance prior to the second indentation contacting the second rib when the second area of the actuator is pressed down.

20. The method according to claim 12, wherein the actuator has side extensions with hooks that can lock the actuator against a base.

21. The method according to claim 12, wherein the first distance is less than the second distance.

22. A system to release spray fluid in different mass flow rate from a container, the system comprising:

an actuator having a first area and a second area;

a stem being connected to the actuator, the stem having a channel along a vertical axis of the stem, the channel being surrounded by a wall of the stem, the stem having a first orifice and a second orifice, the first orifice and the second orifice each having a longitudinal axis disposed perpendicular to the vertical axis, and the first orifice and the second orifice being in communication with the channel through the wall, the wall of the stem having an exterior circumferential groove that forms a neck around an exterior circumference of the stem, the first orifice and the second orifice having openings that are located completely within the exterior circumferential groove of the stem;

a monolithic gasket disposed over the first orifice and the second orifice to directly seal the first orifice and the second orifice in a non-actuated position, the monolithic gasket held in place by the container; and a biased member that biases the stem to the non-actuated position, wherein the stem is movable a first distance relative to the gasket to directly uncover the second orifice while the first orifice is directly covered by the gasket and the stem compresses the biased member to spray fluid with a first mass flow rate when the first area of the actuator is pressed down, and wherein the stem is movable a second distance relative to the gasket to directly uncover the first orifice and the second orifice and the stem compresses the biased member to spray fluid with a second mass flow rate that is greater than the first mass flow rate when the second area of the actuator is pressed down.

23. The system according to claim 22, wherein the monolithic gasket is disposed in the groove.

* * * * *